United States Patent [19]

Pankratz et al.

[11] 4,448,008

[45] May 15, 1984

[54] MULTIPLE MANDREL CARTON ERECTING, FILLING AND SEALING MACHINE WITH TWO-STAGE LOADING

[75] Inventors: Lawrence A. Pankratz, St. Paul; Donald G. Corniea, Inver Grove Heights, both of Minn.

[73] Assignee: Liquipak International, Inc., St. Paul, Minn.

[21] Appl. No.: 319,801

[22] Filed: Nov. 9, 1981

[51] Int. Cl.[3] ..... B65B 43/26

[52] U.S. Cl. ..... 53/202; 53/272; 53/565; 493/165

[58] Field of Search ..... 53/202, 565, 272, 276; 493/165, 164

[56] References Cited

U.S. PATENT DOCUMENTS

| | | | |
|---|---|---|---|
| 3,088,380 | 5/1963 | Vergobbi | 493/164 |
| 3,153,374 | 10/1964 | Borkmann | 493/164 X |
| 3,373,663 | 3/1968 | Heim | 493/164 |
| 3,405,505 | 10/1968 | Mistarz | 53/183 |
| 3,574,294 | 4/1971 | Egli | 493/164 |
| 3,619,979 | 11/1971 | Martensson et al. | 53/565 |
| 3,669,160 | 6/1972 | Mistarz | 141/160 |
| 4,299,590 | 11/1981 | Sasaki | 493/164 |

FOREIGN PATENT DOCUMENTS

| | | |
|---|---|---|
| 709454 | 5/1954 | United Kingdom . |
| 1000155 | 8/1965 | United Kingdom . |
| 1001596 | 8/1965 | United Kingdom . |

OTHER PUBLICATIONS

Brochure on Cherry-Burrell's Model No. NEP/210A.

Brochures on Ex-Cell-O's Model No. 120 and Model No. 125.

*Primary Examiner*—James F. Coan

*Attorney, Agent, or Firm*—Kinney & Lange

[57] ABSTRACT

A machine for erecting flat, collapsed tubular cartons and for filling and sealing the erected cartons provides higher production rates without significantly increasing the cycle rate or the floor space required by the machine. A rotatable mandrel assembly rotates about a horizontal axis and has pairs of radially extending mandrels at equally spaced circumferential positions. The mandrel assembly is driven in a stepwise sequential manner to bring each pair of mandrels sequentially into alignment with a series of work stations. At a loading station, a two-stage loading assembly erects a pair of carton blanks and loads carton blanks onto the pair of mandrels. One carton blank is inserted directly onto a mandrel, while the other carton blank is advanced to an intermediate holding position for loading during the next operating cycle. At subsequent work stations the bottom ends of the carton blanks are formed and sealed. The pair of carton blanks with their bottom ends sealed are then transferred to a substantially horizontal track and are advanced together to subsequent work stations where they are filled and where the top ends are closed and sealed.

13 Claims, 11 Drawing Figures

26
74
16
78
72
72A
72B
76B
68
70
40A
40B
68A
68B
76
76A
24
64
64A
82
80B
36
28
66
18
80
80A
64B
4A
260
278
26A
7
204
232
84
6
316
50
288
20
86
202
205
318
93
314
328
86B
86A
326
324
206
48
322
60
208
87
312
308
207
200
300
320
302
306
304
298
310
296
4

6

MULTIPLE MANDREL CARTON ERECTING, FILLING AND SEALING MACHINE WITH TWO-STAGE LOADING

BACKGROUND OF THE INVENTION

1. Field of the Invention

The present invention relates to machines for erecting flat, collapsed tubular cartons and for filling and sealing the erected cartons. In particular, the present invention relates to a machine which increases production rate without significantly increasing cycle rate.

2. Description of the Prior Art

One common type of container in which liquid food products, such as milk and fruit juices are sold is a gable top carton made of paperboard or the like which has heat sealable top and bottom closure panels. In general, this type of carton is made of a high grade paperboard stock which is coated on both sides with a thermoplastic material such as polyethylene. The polyethylene coating on the paperboard is used for moisture-proofing, and is also a heat and pressure sensitive adhesive used to seal the top and bottom closure panels of the carton to make it liquid tight.

Automatic machines have been developed which erect flat, collapsed cartons of this type, form and seal the bottom ends of the carton, fill the cartons with the liquid product, and form and seal the top ends of the cartons. These machines generally include a rotatable mandrel assembly which is driven in a step-by-step indexing motion. The flat, collapsed cartons are withdrawn from a magazine, erected into an open-end tubular form and loaded onto each mandrel. As the mandrel assembly is rotated, the carton blank on the mandrel is sequentially advanced to work stations at which the bottom closure panels of the blank are broken, the bottom is heated, and the bottom is closed and sealed. Finally, each carton blank, with its bottom end sealed and its top end open, is withdrawn from its mandrel and deposited on a conveyor line. The cartons on the conveyor line are advanced through a top breaker unit at which the top panels are broken, a filling area at which the cartons are filled with the desired quantity of liquid, a defoamer area at which foam generated during the filling of the liquid is removed, a top heater area at which the polyethylene coating on the carton is heated, a top folding area at which the top panels are folded, and a top sealing area at which the tops of the cartons are sealed.

Examples of machines of this general type are shown in U.S. Pat. Nos. 3,088,380; 3,153,374; 3,405,505; and 3,669,160; and in British Pat. Nos. 709,454; 1,001,595; and 1,001,596.

There has been a continuing effort to increase the production rate of this type of machine. One way of increasing production rate, of course, is to run the machine at higher cycle rates. This approach, however, has practical limitations. The rate at which carton forming and sealing and the filling of liquid can be performed places practical limitations on the maximum cycle rate of the machine. In addition, as higher cycle rates are required, more complex mechanisms are often required. Higher cycle rates can also result in higher incidence of breakdown and the need for greater amounts of maintenance.

In the past, several approaches have been proposed to increase the production rate of machines of this type without significantly increasing cycle rate. For example, one type of machine uses four mandrel assemblies driven on a common horizontal axis. The four mandrel assemblies feed cartons onto four parallel, horizontal conveyor tracks. The cartons are advanced along the four tracks one step per cycle to the various work stations at which the cartons are filled and the top ends are formed and sealed. The four mandrel assemblies are arranged in four vertical planes which are parallel to the four conveyor tracks. This machine, therefore, is effectively four machines operating in parallel but driven by a common drive system. While this approach achieves a four-fold increase in production rate over a machine with a single mandrel assembly and a single conveyor line, there are significant disadvantages. In particular, because the four lines and four mandrel assemblies are in parallel with one another, access to the mechanisms of the two inner lines and inner mandrel assemblies is difficult. Since access is required in order to perform regular periodic maintenance and cleaning as well as for repairs, the use of four parallel conveyor lines and four parallel mandrel assemblies is extremely inconvenient. In addition, the use of four parallel conveyor lines and four parallel mandrel assemblies significantly increases the floor space required for the system, and results in approximately a four-fold increase in the number of parts and components of the machine.

Another approach to increasing production rate uses a mandrel assembly which rotates about a vertical axis. The mandrels all extend downward from the horizontal mandrel carriage or spindle. This system uses a pair of mandrels at each of a plurality of equally spaced positions around the horizontal mandrel carriage. Two cartons are erected and sealed simultaneously on the mandrel assembly. The two cartons are then deposited into a single conveyor line which carries each pair of cartons step-by-step along a horizontal track. Because two cartons are formed, filled and sealed simultaneously, twice the production is achieved with the same cycle rate. This type of system, however, also has disadvantages. The orientation of the mandrel carriage in a horizontal plane with a vertical axis of rotation takes up considerable floor space. In addition, in order to obtain a four-fold increase in production rate with the same cycle rate, two similar machines must be placed side-by-side. This proposed arrangement has not proved acceptable due to the large amount of floor space required and the problems presented in accessibility to certain components of the machines.

Still another proposal for increasing production rate also uses a horizontally aligned mandrel assembly which rotates about a vertical axis and which has pairs of mandrels extending downward from the mandrel carriage. The cartons are removed at the last work station around the mandrel assembly and are deposited into two separate conveyor tracks. The individual cartons are then indexed one at a time through the remainder of the machine. This arrangement achieves a two-fold increase in production rate, but again does not lend itself to further increases in production rate without doubling the floor space required by arranging two machines side-by-side.

Still another approach uses four mandrel assemblies arranged in two pairs. Each pair of mandrel assemblies is driven on a common horizontal axis, and each mandrel assembly is aligned in a vertical plane. One pair of mandrel assemblies feeds one horizontal conveyor track, and the other pair of mandrel assemblies feed another horizontal track. The vertical planes of the mandrel assemblies are perpendicular to the horizontal tracks. Cartons deposited in the horizontal tracks are moved in pairs stepwise through the remainder of the machine. As a result, a four-fold increase in production rate is achieved. This type of system, however, has the disadvantage that it consumes considerable floor space, due to the orientation of the mandrel assemblies. In addition, access to some parts of the machines can be difficult.

Still another approach to increasing cycle rates uses four mandrel assemblies which are driven on a common horizontal axis. Two of the mandrel assemblies feed cartons onto one horizontal conveyor track, while the other two mandrel assemblies feed cartons onto a second horizontal conveyor track. The vertical planes in which each of the mandrel assemblies are located are generally parallel to the horizontal conveyor tracks. This system uses a mechanical cross-over arrangement in order to feed two cartons at a time into each of the two conveyor tracks. The conveyor tracks then advance the cartons in pairs through the various work stations of the remainder of the machine. While this machine achieves a four-fold increase in production rate, it has increased complexity due to the feeding of cartons from two separate mandrel assemblies into a single conveyor line. In addition, having four mandrel assemblies on a common shaft for rotation presents problems with respect to accessibility of components positioned around the inner two mandrel assemblies, and requires greater power to rotate the four mandrel assemblies.

There is a continuing need for improved machines which erect flat, collapsed cartons and which fill and seal those cartons. In particular, there is a continuing need for machines which provide higher effective production rates without consuming excessive amounts of floor space and which permit easy accessibility to all components of the machine for service and maintenance adjustments.

SUMMARY OF THE INVENTION

The present invention is a machine for erecting flat collapsed cartons and for filling and sealing the erected cartons which provide higher effective production rates. The machine includes a mandrel assembly which is rotatably driven with a step-by-step indexing motion about a horizontal axis of rotation. The mandrel assembly includes a pair of mandrels at each of a plurality of equally spaced circumferential positions. Each pair of mandrels extends outward in a generally radial direction with respect to the horizontal axis of rotation.

The erection of the cartons and the sealing of bottom ends of the carton are performed two at a time on the mandrel assembly by a plurality of work stations which are positioned in a substantially vertical plane which is normal to the horizontal axis of rotation of the mandrel assembly. The mandrel assembly is rotated in the vertical plane about the horizontal axis in a stepped sequence to bring each pair of mandrels sequentially into alignment with each work station.

Carton transfer means successively transfers each pair of carton blanks, after their bottom ends have been sealed, from each pair of mandrels to a substantially horizontal track. Carton conveyor means operatively synchronized with the intermittent drive means advances each pair of carton blanks along the horizontal track to work stations where each pair of carton blanks is filled, closed and the top ends sealed.

The machine of the present invention is particularly advantageous since it provides a two-fold increase in production rate with a single horizontal conveyor track and a single mandrel assembly. This minimizes floor space, since the mandrel assembly is oriented in a common vertical plane with the horizontal track and rotates about a horizontal axis of rotation. In addition, the machine of the present invention is particularly well adapted to achieve a four-fold increase in production rate by use of a second identical mandrel assembly which is connected to the first mandrel assembly and is rotated about the same horizontal axis of rotation. Cartons from the second mandrel assembly are fed along a second horizontal track which is parallel to the first track. This four-fold increase in production rate is achieved with a minimum of additional floor space, and permits easy accessibility to all components of the machine for cleaning, service and maintenance adjustment.

In preferred embodiments, the machine of the present invention utilizes a unique two-stage carton erecting and loading mechanism in order to simultaneously load each pair of mandrels of the mandrel assembly. The loading assembly includes first and second magazines for holding first and second supplies of carton blanks, respectively. First picker means removes a carton blank from the first magazine, opens the flat carton blank to a generally square cross-section open end tubular form, and deposits the erected open end tubular carton blank in a first chute. First loading means advances the open end tubular carton blank deposited by the first picker means along the first chute onto one of the pair of mandrels.

Second picker means removes a flat carton blank from the second magazine, opens the flat carton blank to a generally square cross-section open-ended tubular form, and deposits the tubular carton blank in a second chute. Second loading means simultaneously advances the open end tubular carton blank deposited by the second picker means along the second chute to an intermediate position while advancing a previously deposited carton blank from the intermediate position onto the other mandrel.

DETAILED DESCRIPTION OF THE PREFERRED EMBODIMENTS

Figure 1:
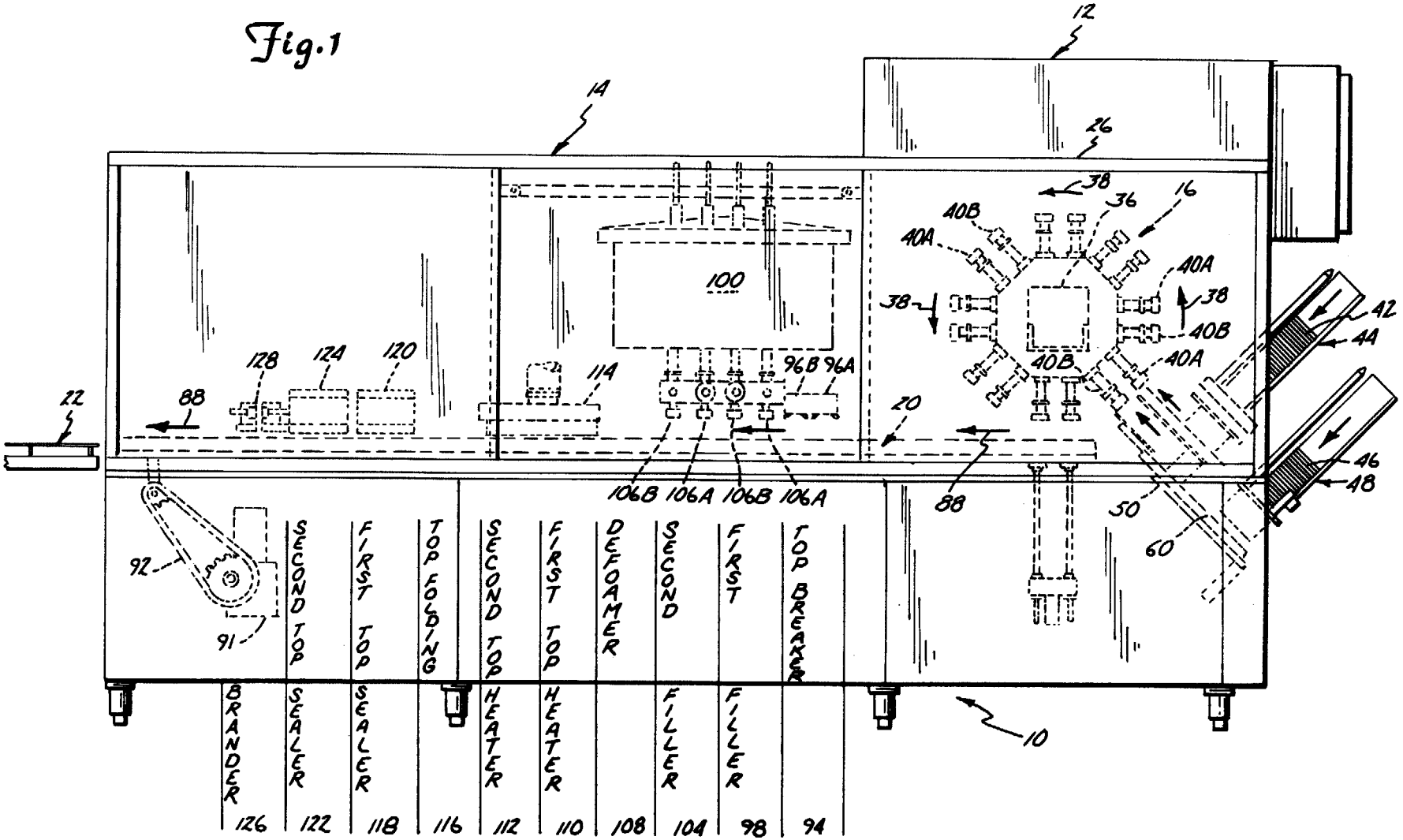
FIG. 1 is a side elevation of a machine for erecting flat collapsed cartons and for filling and sealing the erected cartons which embodies the persent invention.
Figure 2:
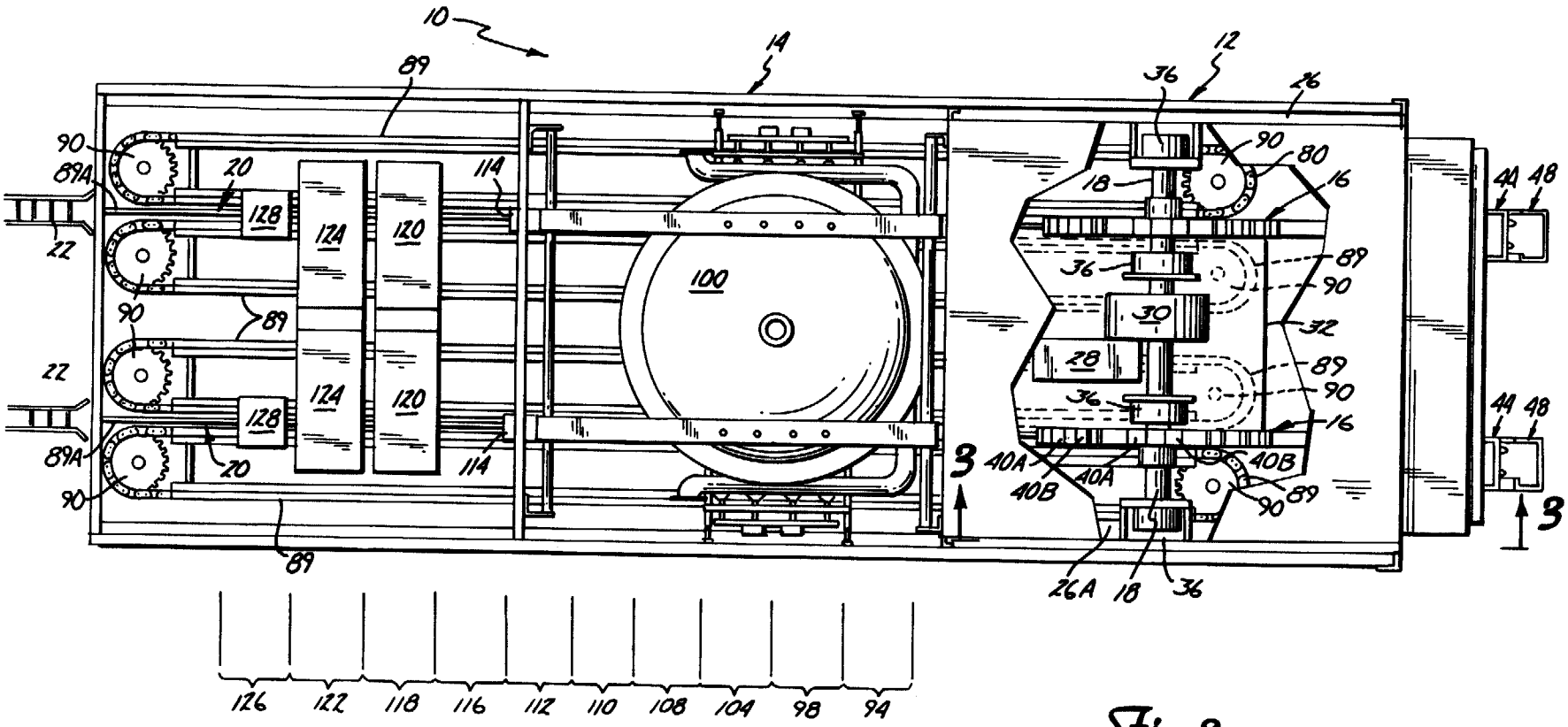
FIG. 2 is a top plan view of the machine of FIG. 1.

In FIGS. 1 and 2, carton erecting, filling and sealing machine 10 is shown which embodies the present invention. Machine 10 is a double indexing/dual conveyor line machine which provides a four fold increase in production rate with the same cycle rate compared to a conventional single line machine.

As illustrated in FIGS. 1 and 2, machine 10 includes a carton erecting section 12 and a filling and sealing section 14. Carton erecting section 12 includes a pair of vertically oriented mandrel assemblies 16 which are rotated in stepwise fashion about a common horizontal axis of rotation defined by mandrel drive shaft 18. Cartons formed on mandrel assemblies 16 are deposited into a pair of parallel horizontal conveyor tracks 20. The cartons deposited in conveyor tracks 20 have sealed bottom ends and open top ends. As the cartons are advanced along conveyor tracks 20 they are brought sequentially into alignment with a series of work stations where they are filled and top sealed. The cartons are eventually driven off the end of conveyor lines 20 onto conveyor assembly 22.

For the purpose of further description and discussion, only one of the two parallel mandrel assembly/conveyor lines of machine 10 will be described. It should be understood, however, that each of the two parallel lines has identical components and operates in the same manner. Similar reference numerals will be used to designate similar elements and components of each of the two parallel lines.

Figure 3:
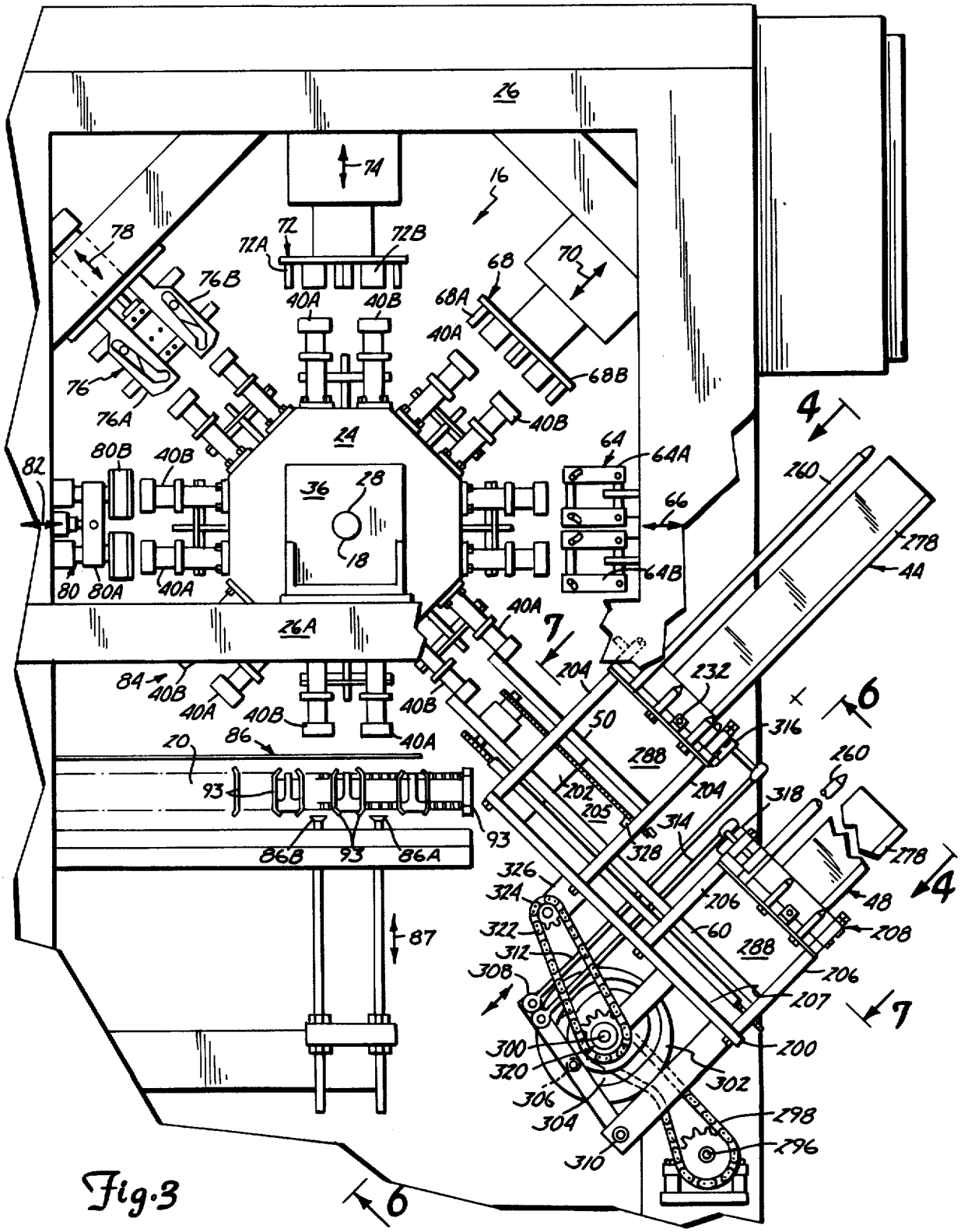
FIG. 3 is a sectional view along section 3—3 of FIG. 2.

As shown in FIG. 1-3, mandrel assembly 16 includes an octagonal spindle 24 which is rotatably mounted with respect to frame 26 so that it rotates about the horizontal axis defined by drive shaft 18.

As best shown in FIG. 2, mandrel assembly drive shaft 18 is driven by hydraulic motor 28 through indexing transmission 30. As shown in FIG. 2, hydraulic motor 28 and indexing transmission 30 are both mounted on motor mounting platform 32, which is attached to frame 26. Drive shaft 18 is supported for rotation in bearings 34, which are mounted to motor mounting platform 32. At its outer ends, drive shaft 18 is supported by bearing plates 36, which in turn are mounted on cross members 26A of frame 26. Mandrel drive shaft 18 is driven in a step-by-step sequential motion in the direction illustrated by arrows 38 in FIG. 1.

Mounted on each of the eight surfaces of octagonal spindle 24 are a pair of mandrels 40A, 40B. Each pair of mandrels 40A, 40B projects outwardly in a generally radial direction, and all mandrels lie in a common vertical plane which is perpendicular to the horizontal axis defined by mandrel drive shaft 18. By the use of a pair of mandrels 40A, 40B at each position of mandrel assembly 16, two cartons rather than one are formed at the same time. As spindle 24 is rotated, it brings each pair of mandrels 40A, 40B into alignment with each of a series of work stations, where work is performed on the carton. This ultimately results in the sealing of the bottom ends of the pair of cartons and the depositing of that pair of cartons into conveyor line 20.

The cartons which are formed and filled in machine 10 are originally in the form of collapsed open-ended tubular flat cartons. The closure parts at each end of the carton blanks are suitably scored so that the top and bottom ends will be formed with the proper configuration after the carton blanks have been erected into tubes having a generally square cross-section.

A first stack 42 of carton blanks (shown in FIG. 1) is stored in first magazine 44, and a second stack 46 of flat carton blanks (FIG. 1) is stored in second magazine 48. During each operating cycle of machine 10, an erected carton blank in upper chute 50 is advanced along upper chute 50 from a position below first magazine 44 onto mandrel 40A. In addition, the lowermost carton blank in first magazine 44 is pulled downward, erected, and deposited in upper chute 50 just below first magazine 44, so as to be ready for the next cycle.

During the same cycle, two erected carton blanks in lower chute 60 are advanced. One carton blank is advanced from an intermediate holding position generally below first magazine 44 onto mandrel 40B while the other carton is advanced from a position below second magazine 48 to the intermediate holding position. The lowermost carton blank in second magazine 48 is pulled downward, erected, and deposited in lower chute 60 just below second magazine 48 so as to be ready for the next cycle.

This two-stage loading, which will be described in further detail later, allows two separate magazines 44 and 48 and loading chutes 50 and 60 to be positioned in close proximity without interfering with one another, and allows two cartons to be inserted onto closely spaced mandrels 40A and 40B simultaneously.

After a pair of cartons have been inserted on mandrels 40A and 40B, the next cycle of machine 10 is commenced and spindle 24 is rotated in the counterclockwise direction illustrated by arrows 38 in FIG. 1 to bring the carton blanks into alignment with bottom breaker assembly 64. As illustrated in FIG. 3, bottom breaker assembly 64 includes a pair of bottom breaker mechanisms 64A and 64B which are driven inward in the direction indicated by arrow 66 to engage the bottom end flaps of the cartons mounted on mandrels 40A and 40B, respectively. Bottom breaker mechanisms 64A and 64B break the score lines of the bottom ends of the cartons on mandrels 40A and 40B, respectively, and are then retracted as illustrated by arrow 66.

During the next cycle, spindle 24 is rotated to bring mandrels 40A and 40B into alignment with first bottom heater assembly 68, which includes a pair of bottom heaters 68A and 68B. First bottom heater assembly 68 is driven inward as illustrated by arrow 70 in FIG. 3 and applies heat to the bottom ends of the pair of cartons to soften the polyethylene coating on the paperboard forming the cartons.

During the next cycle, spindle 24 is rotated to bring mandrels 40A and 40B into alignment with second bottom heater assembly 72, which includes a pair of bottom heaters 72A and 72B. Second bottom heater assembly 72 is moved in the direction generally illustrated by arrow 74, and further heats the bottoms of the cartons mounted on mandrels 40A and 40B.

The next operating cycle causes spindle 24 to rotate mandrels 40A and 40B into alignment with bottom folding assembly 76, which includes a pair of bottom folding mechanisms 76A and 76B. Bottom folding assembly 76 is movable in the direction illustrated by arrow 78 in FIG. 3. Bottom folding assembly 76 folds the bottom ends of the cartons closed and sets up the polyethylene coating with one flap of the carton folded onto the other to obtain a good bottom seal.

During the next cycle, mandrels 40A and 40B are brought into alignment with bottom press assembly 80, which includes a pair of bottom presses 80A and 80B. Bottom presses 80A and 80B are driven inwardly as illustrated by arrow 82 to engage and press the bottom ends of the pair of cartons on mandrels 40A and 40B. Bottom presses 80A and 80B each preferably have a series of stakes which block off any channels in the bottom of the cartons to prevent the bottoms of the cartons from leaking. Bottom presses 80A and 80B are chilled to draw heat from the polyethylene coating and thus ensure a well sealed bottom end of each carton.

During the next operating cycle mandrels 40A and 40B are brought in alignment with a blank station 84. No work is performed on the cartons at blank station 84.

During the next operating cycle, mandrels 40A and 40B are brought into alignment with unloader station 86. Unloader vacuum cups 86A and 86B are positioned at unloader station 86, and are driven upward in the direction indicated by arrow 87 to engage the bottom ends of the pair of cartons mounted on mandrels 40A and 40B. Vacuum cups 86A and 86B are then driven downward to deposit the pair of cartons into conveyor 20.

Once the cartons have been stripped off mandrels 40A and 40B by vacuum cups 86A and 86B and deposited in conveyor 20, mandrels 40A and 40B are ready to be indexed back to the loading station to be loaded with another pair of carton blanks.

Each pair of cartons deposited in conveyor 20 progresses along conveyor 20 in the direction illustrated by arrows 88 in FIG. 1. Machine 10 of the present invention provides a double index movement of cartons along conveyor 20. In other words, the cartons are moved by pairs from one work station to another, so that each operation on the cartons is performed essentially simultaneously on both cartons. As a result, the production rate of filled and sealed cartons from each conveyor line 20 is twice the cycle rate, since two cartons are being constructed, filled and sealed with each cycle.

Conveyor 20 includes a pair of endless chain assemblies 89 and a longitudinal horizontal bottom support rod 89A which are trained over sprockets 90 and are driven by motor 91 through chain drive 92. Chain assemblies 89 are arranged in spaced parallel arrangement with their inner runs defining the conveyor track along which the pairs of cartons are transported. Each chain assembly carries carton-engaging dogs 93 which are longitudinally spaced and are arranged in transverse registration to define pockets within which the cartons are deposited. The cartons ride in the pockets with their bottom ends supported on rod 89A.

After being deposited in conveyor chain 20 at unloading station 86, the pair of cartons is advanced together through a series of work stations. The first several work stations after the unloading area 86 are not shown, but may include, for example, stations for inspecting selected cartons to ensure that the bottom sealing function has been performed satisfactorily. After these initial stations, the pair of cartons is indexed to top breaker station 94. A pair of top breaker assemblies 96A and 96B are located at top breaker work station 94 to prebreak the top ends of the pair of cartons. This softens up the score lines of the top ends of the cartons in preparation for later top forming and sealing.

The pair of cartons is then indexed to first filler station 98. Milk or other liquid is dispensed from tank reservoir 100 through nozzles 102A and 102B into the pair of cartons. A measured quantity of liquid is dispensed into each of the two cartons by a pumping apparatus. This pumping apparatus is the subject matter of a copending patent application entitled "Carton Filling Apparatus" which is filed on even date with this application and assigned to the same assignee as the present application.

During the next indexing of conveyor 20, the pair of cartons are brought into alignment with second filler station 104. The remaining quantity of liquid required to fill the cartons to the desired volume are dispensed through nozzles 106A and 106B, respectively.

The next station to which the pair of cartons is indexed is defoamer station 108. At this station, a set of tubes (not shown) is moved downward into the pair of cartons to remove any foam that may be in the cartons and which would otherwise prevent the tops of the cartons from sealing properly.

Next, the pair of cartons are indexed into first top heater station 110, and on the following cycle are indexed into second top heater station 112. In top heater stations 110 and 112, top heater assembly 114 heats the polyethylene on the top ends of the carton so that the polyethylene is soft and ready for the sealing operation.

The pair of cartons are then indexed into top folding station 116 where the tops are folded and then to first top sealer station 118. First top sealer assembly 120 closes the top ends of the pair of cartons and applies compression to the top ends to seal the top ends of the cartons.

The pair of cartons are next indexed to second top sealing station 122. Second top sealer 124 performs a second top sealing operation to ensure that the tops of the two cartons are properly sealed.

Finally, the pair of cartons are indexed to brander station 126. Brander assembly 128 burns the expiration date of the product onto the top lids of the pair of cartons.

With subsequent cycles of machine 10, the pair of cartons are indexed until they reach the end of conveyor 20 are are deposited onto conveyor assembly 22.

The double mandrel/double index machine 10 of the present invention provides significant advantages over prior art machines. First, because two cartons are being formed, filled and sealed at each station, twice the production rate is provided with the same cycle rate.

Second, because mandrel assembly 16 is in the same vertical plane as conveyor line 20 and rotates about a horizontal axis which is perpendicular to that vertical plane, two mandrel assemblies and conveyor lines can be operated side-by-side in a compact single machine to provide a four fold increase in production rate with the same cycle rate.

Third, the two-mandrel assembly, two-conveyor line arrangement as illustrated in FIGS. 1 and 2 allows a common drive system to operate both mandrel assemblies and both conveyor lines with a minimum of complexity.

Fourth, the two-mandrel assembly, two conveyor line arrangement of FIGS. 1 and 2 permits easy accessibility to all parts of machine 10 for repairs, cleaning and maintenance adjustments. In particular, mandrel assemblies 16 and the work stations arranged about mandrel assemblies 16 are all easily accessible.

Fifth, the two-mandrel assembly, two-conveyor line machine of FIGS. 1 and 2 takes up a minimum of floor space to achieve a four-fold increase in production rate. This is in contrast to prior art systems having different orientations of the mandrel assembly.

Figure 6:
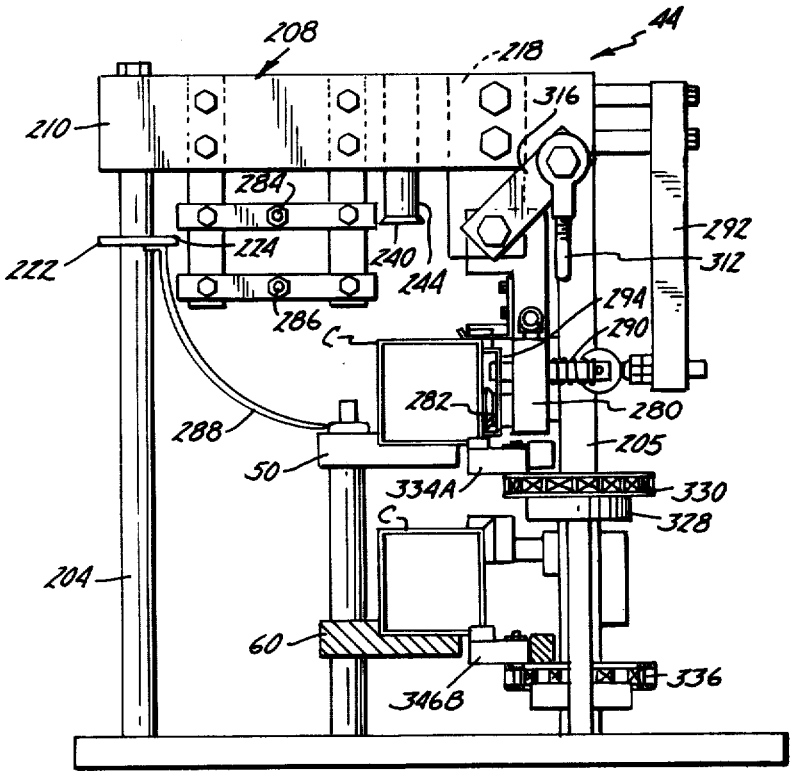
FIG. 6 is a view along line 6—6 of FIG. 3.

As described previously, the machine of the present invention uses a two-stage loading apparatus in order to insert erected cartons blanks onto the closely spaced parallel mandrels 40A and 40B aligned with the loading station. The structure and operation of this two-stage loading apparatus is shown in detail in previously discussed FIG. 3, and in FIGS. 4–6.

The two-stage loading assembly is supported on base plate 200, which is fixed to frame 26. In the embodiment shown in the Figures, base plate 200 is inclined at a 45° angle so that it is parallel to the radial direction of mandrels 40A and 40B when mandrels 40A and 40B are at the loading station. First and second chutes 50 and 60 are supported by support posts 202 which extend perpendicularly to base plate 200. Chutes 50 and 60 are mounted parallel to base plate 200 and extend upward from magazines 44 and 48, respectively, to mandrels 40A and 40B.

First magazine 44 is supported above base plate 200 by support posts 204 and mounting plate 205, which are mounted to base plate 200 and extended generally upwardly and perpendicular to base plate 200. Similarly, second magazine assembly 48 is supported by support posts 206 and mounting plate 207, which are fixed to base plate 200 at their lower end and extend perpendicularly to base plate 200.

The structure and operation of first and second magazines 44 and 48 and the mechanisms for pulling down and erecting cartons into chutes 50 and 60 are essentially identical. For that reason, similar reference numerals and characters will be used to designate similar elements, and the following description will be applicable to both. Magazines 44 and 48 include basket assembly 208 mounted at the upper ends of support posts 204 or 206. Basket assembly 208 includes a pair of parallel end members 210 and 212. Side member 214 extends between end members 210 and 212 and is connected to members 210 and 212 by bolts 216. Brace 218 is parallel to side member 214 and is connected to ends 210 and 212 by bolts 220.

Across the opposite side of the magazine base 208 from side member 214 is chamfer plate 222, which plate 222 is supported on posts 204 slightly below the lower surface of end members 210 and 212. Chamfer plate 222 has a chamfered edge 224 which provides support for the edge of the lowermost carton in the magazine. Mounted on chamfer plate 222 and extending upward in a perpendicular direction are basket rods or arbors 226 and 228. Basket rods 226 and 228 extend upward to about the top or basket assembly 208 to provide guidance for one side edge of the carton blanks as the carton blanks drop into basket assembly 208. Also mounted on chamfer plate 222 is adjustable stack separator 230, which includes a flexible leaf spring 232 which has a flange 234 which extends into the stack of cartons to separate the lower four or five cartons from the remainder of the stack. This prevents the entire weight of all the stack of cartons in the magazine from pressing down on the lowermost carton blank. The position of leaf spring 232 is adjusted by adjusting screw 236, which extends through block 238 and engages the backside of leaf spring 232.

The opposite side edge of the lowermost carton blank is supported on edges of bevel washers 240 and 242, which are attached to the bottom ends of basket rods or arbors 244 and 246, respectively. Basket rods 244 and 246 are mounted on supports 248 and 250, respectively, which extend outward from brace 218. Basket rods 244 and 246 have a height which is about the same as basket rods 226 and 228, and provide guidance of the carton blanks down to the lowermost position (or "pickoff point") defined by chamfered edge 224 of chamfer plate 222 and edges of bevel washers 240 and 242.

Two additional short basket rods 252 and 254 are attached to end member 210 by bolts 256 and 258, respectively. Basket rods 252 and 254 provide guidance for the bottom end edges of the carton blanks in basket assembly 208.

The top end edges of the carton blanks are guided by a pair of tall arbors 260 and 262, which are attached by bolts 264 and 266 to movable support 268. Since the length of the carton blanks can vary, support 268 is mounted on guide rods 270 and 272, which extend through sleeves 274 and 276 and end member 212. Sleeves 274 and 276 are fixedly mounted to end member 212. Proper placement of arbors 260 and 262 for use with a particular length of carton blank is provided by insertion of hairpins (not shown) through holes in sleeves 274 and 276 and cooperating holes in guide rods 270 and 272, respectively.

As best shown in FIG. 3, magazines 36 and 40 also include an L-shaped metal member 278 which, together with tall arbors 260 and 262, provides a guide structure for holding a tall stack of carton blanks. L-shaped member 278, which is not shown in FIG. 4 for purposes of clarity, has a flange at its lower end to permit attachment by screws or other fasteners to end 210 and brace 218 of basket assembly 208. One inner edge of L-shaped member 278 sits immediately above basket rods 244 and 246, while the other edge sits immediately above basket rods 252 and 258.

Figure 4:
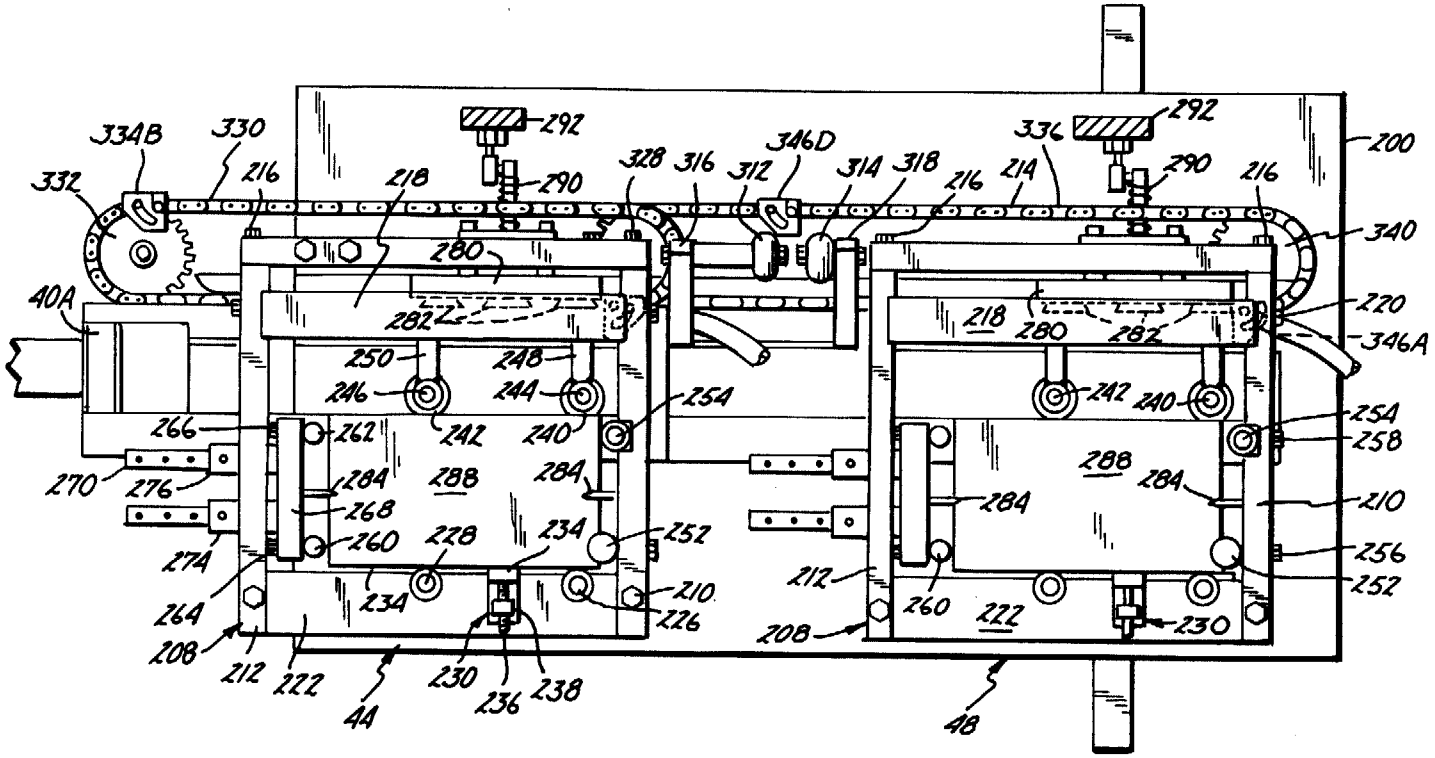
FIG. 4 is a view along line 4—4 of FIG. 3 showing the carton loader assembly.
Figure 5:
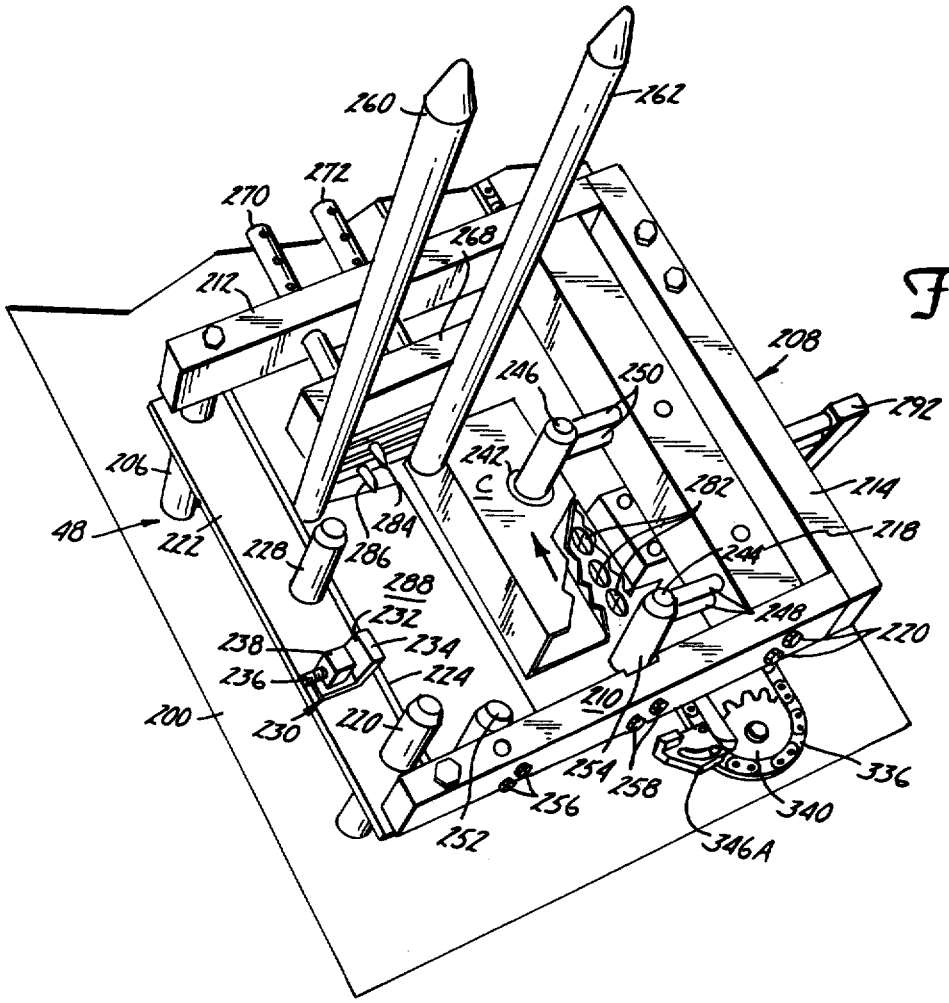
FIG. 5 is a perspective view of the basket area of the upper carton loader assembly.
Figure 8:
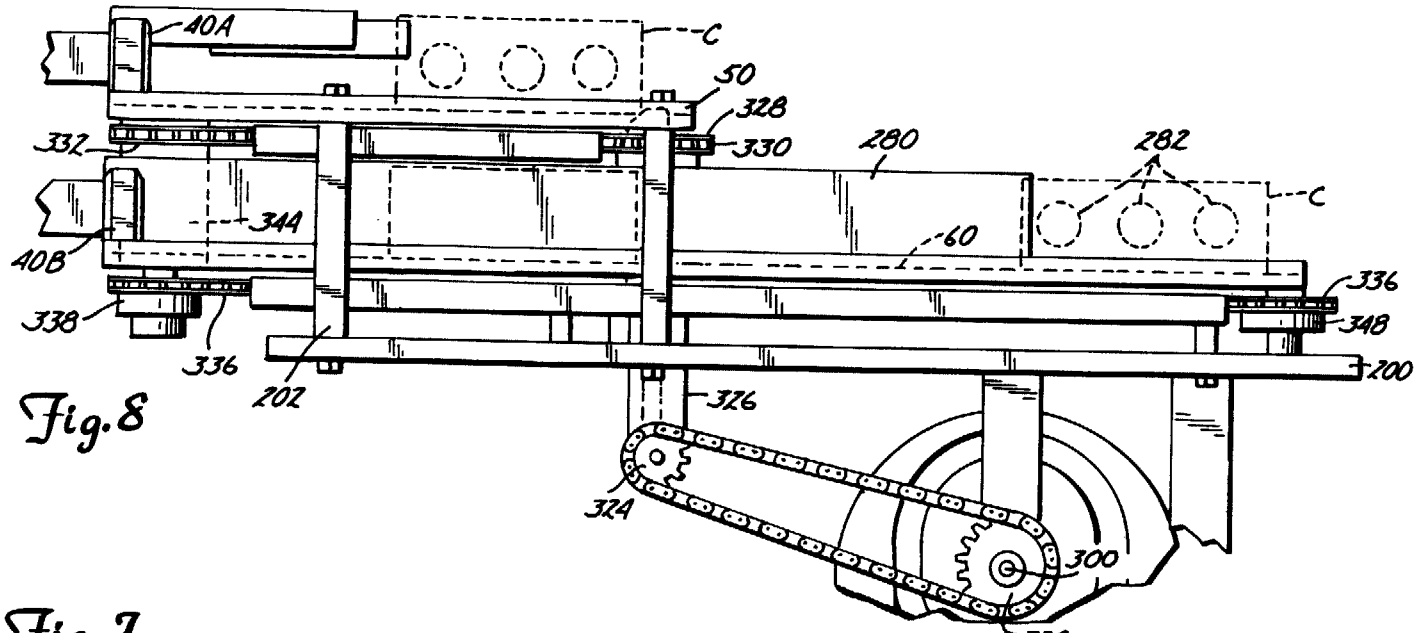
FIG. 8 is a view along line 8—8 of FIG. 7 illustrating the positions of cartons in phantom on the first and second chutes.
Figure 7:
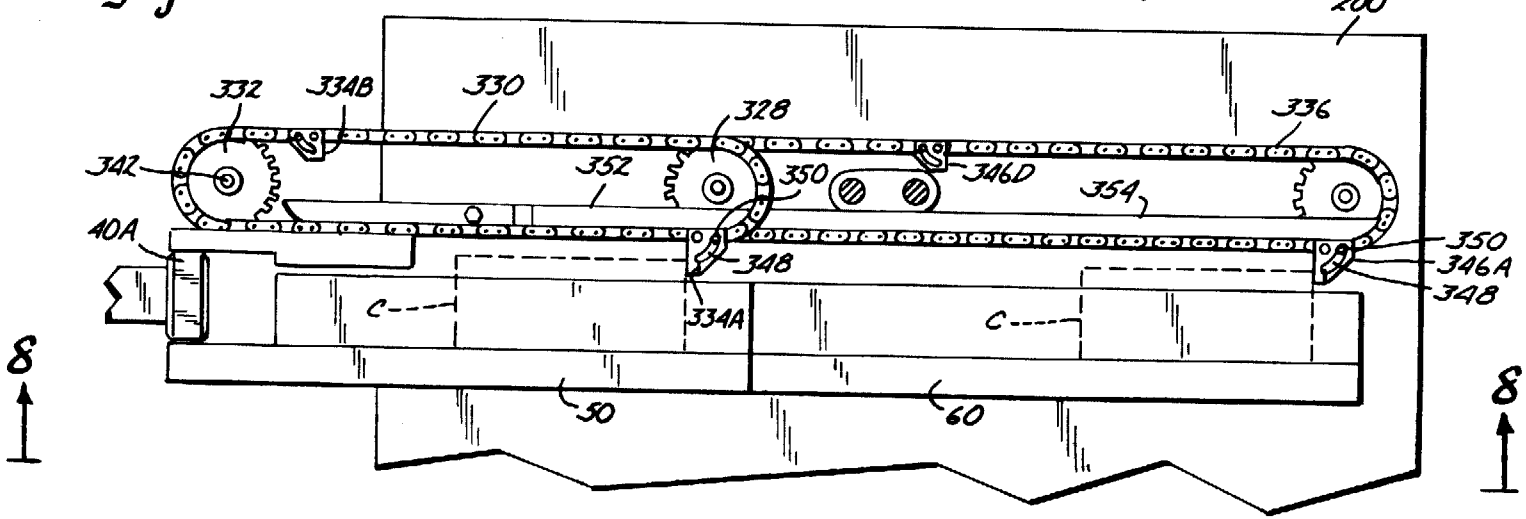
FIG. 7 is a view along line 7—7 of FIG. 6 illustrating in phantom the position of erected cartons along the first and second chutes of the loader prior to advancement of the erected cartons along the chutes.

The lowermost carton blank is withdrawn from basket assembly 208, erected and deposited in chute 50 or chute 60 (as the case may be) by rotatable picker head 280. Picker head 280 is a vacuum block having three vacuum picker cups 282. As shown in FIG. 4, picker head 280 is in its down or rest position below brace 218. During an operating cycle, picker head 280 is pivoted upward so that picker cups 282 engage a side panel of the lowermost carton being held by chamfered edge 224 and bevel washers 240 and 242. As picker head 280 swings back downward it pulls the lowermost carton blank with it out of engagement with the pickoff point defined by chamfered edge 224 and bevel washers 240 and 242.

Mounted at each end of the basket area are two sets of picker fingers 284 and 286. The upper pair of picker fingers 284 retard the back panel of the carton blank as the carton blank is being pulled downward by picker head 280 and prevents the carton blank from assuming a L-shaped cross-section. The second lower pair of picker fingers 286 engage the back panel a second time after it has been released from the pickoff point of basket assembly 208 which retards the back panel and assures positive opening of the carton blank.

Positioned below the pickoff area is a curved guide plate 288 which provides a guiding surface for the carton blank down to its respective chute 50 or 60.

As picker head 280 reaches its lower rest position, spring loaded retainer rod actuator 290 strikes stop 292. Retainer rod 290 pushes retainer bar 294 outward which pushes the carton off of vacuum picker cups 282. At the same time, a cam operated limit switch (not shown) operated by the drive system of picker 280 triggers a vacuum valve (not shown) which breaks the vacuum being supplied to vacuum picker cups 282 and provides a small amount of positive air pressure to ensure that the erected carton blank snaps off of vacuum cups 282.

The drive mechanism for picker head 280 is illustrated more fully in FIG. 3. Drive shaft 296 provides drive power through chain drive 299 to auxiliary drive shaft 300. Mounted on auxiliary shaft 300 is cam plate 302, which has a cam follower track 304 formed in its surface. Cam follower 306, which is mounted on cam follower arm 308, rides in cam follower track 304.

Cam follower arm 308 is pivotally attached to brace 310 at one end, and has the lower ends of a pair of linkages 312 and 314 pivotally connected at its outer end. The upper end of linkage 312 is connected to the upper end of link arm 316, which in turn is connected to picker head 280 of magazine 44. Similarly, linkage 314 is connected at its upper end to the upper end of link arm 318, which in turn is connected to picker head 280 of magazine 48. As the cam plate 304 rotates and the outer end of cam follower arm 308 moves downward, linkages 312 and 314 are pulled downward, thus pulling down the upper ends of link arms 316 and 318, respectively. This causes picker heads 280 to be pivoted upward to engage the lowermost carton blank in magazines 44 and 48. As cam plate 302 continues to rotate, cam follower 306 rides in cam track 304 and causes follower arm 308 to move upward, thus moving the upper ends of link arms 316 and 318 upward and pivoting picker heads 280 downward.

Once the erected carton blanks C have been deposited in chutes 50 and 60, they are advanced by a chain drive system which derives power from drive shaft 296. Mounted on auxiliary shaft 302 is sprocket 320. Endless drive chain 322 is trained over sprocket 320 and sprocket 324 so that sprocket 324 is rotated as shaft 300 is rotated. Drive power is transferred from sprocket 324 through right angle drive 326 to sprocket 328 and thereby to upper drive chain 330. Upper drive chain 330 is an endless chain which is trained over sprocket 328 and sprocket 332. Upper drive chain 330 has a pair of pivotable carton pushing lugs 334A and 334B mounted at equal distances from one another. Lugs 334A and 334B push the carton blank C located in top chute 50 onto mandrel 40A.

Advancement of cartons C along lower chute 60 is provided by lower drive chain 336, which is an endless chain which is trained over sprocket 338 and sprocket 340. Sprocket 338 is coaxially mounted on common shaft 342 with sprocket 338. Shaft 342 extends downward from sprocket 332 to sprocket 338 through bearing block 344, and transfers drive power from upper chain 330 to lower chain 336. Thus drive chains 330 and 336 are exactly synchronized with one another.

Lower drive chain 336 is exactly twice the length of upper chain 330, and has four equally spaced lugs 346A-346D for advancing cartons along lower chute 60.

Lugs 334A-334B and 346A-346D are pivotally mounted to chains 330 and 336, respectively. This pivotal movement of lugs 334A-334B and 346A-346D is permitted by an arcuate slot 348 which cooperates with a pin 350 on chain 330 or 336. This pivotal movement allows the lugs to fold inward during the return movement of chains 330 and 336. When a lug 334A-334B is moving along chute 50 to push a carton blank, lug 334A or 334B is held in a pushing position by lug guide rail 352. Similarly, lug guide rail 354 maintains lugs 346A-346D on lower chain 336 in a pushing position as they travel along lower chute 60.

Figure 9A:
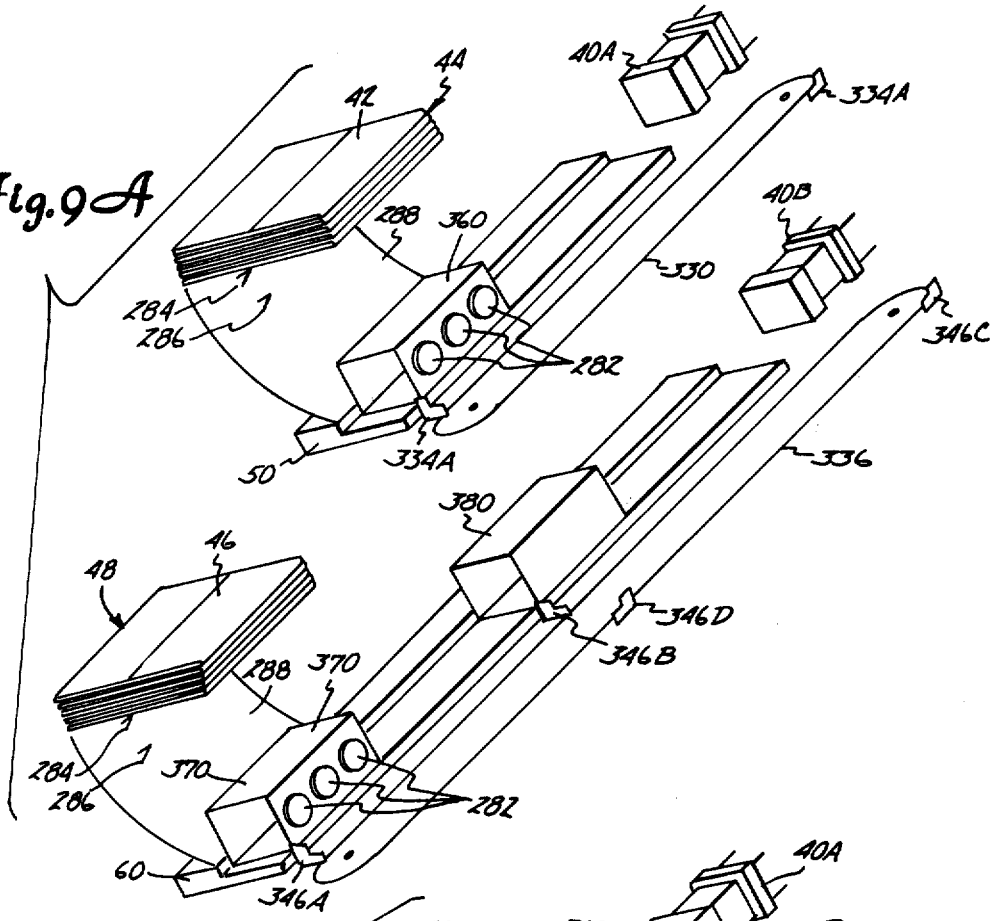
FIGS. 9A–9C are schematic representations of operation of the two-stage loading assembly of the present invention.
Figure 9B:
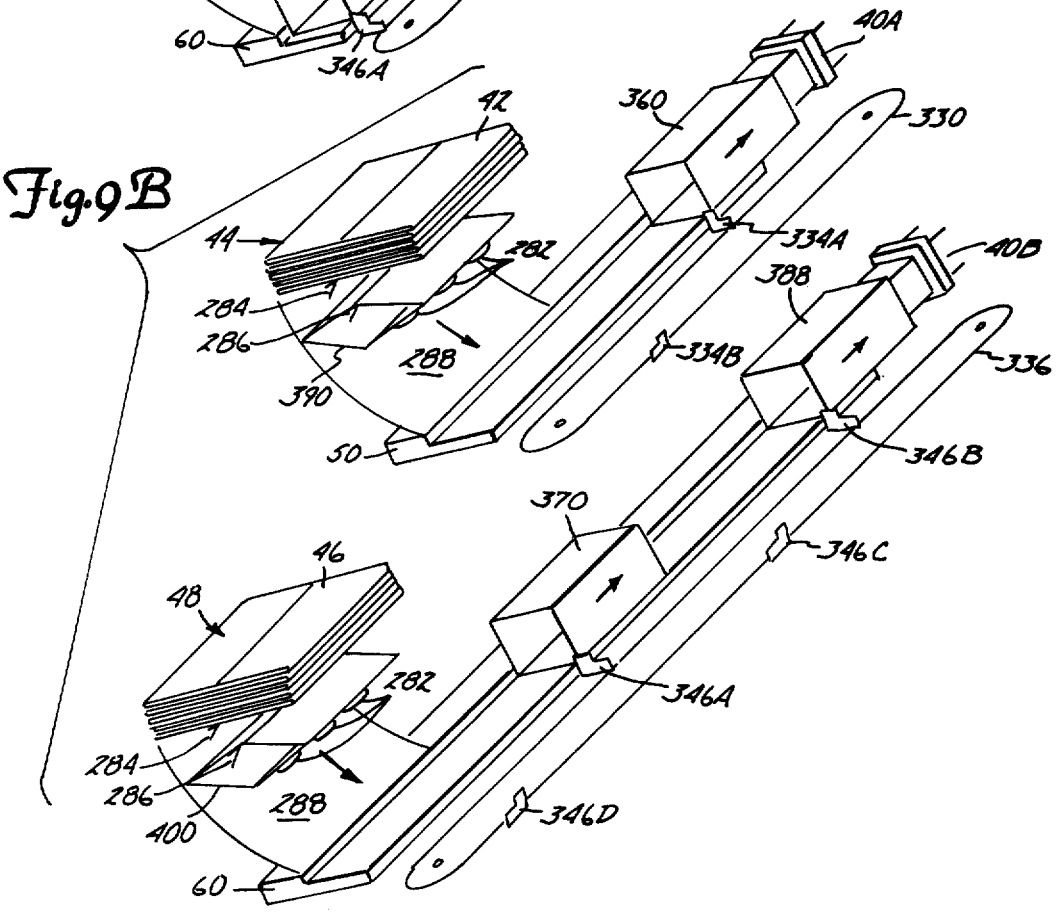
Figure 9C:
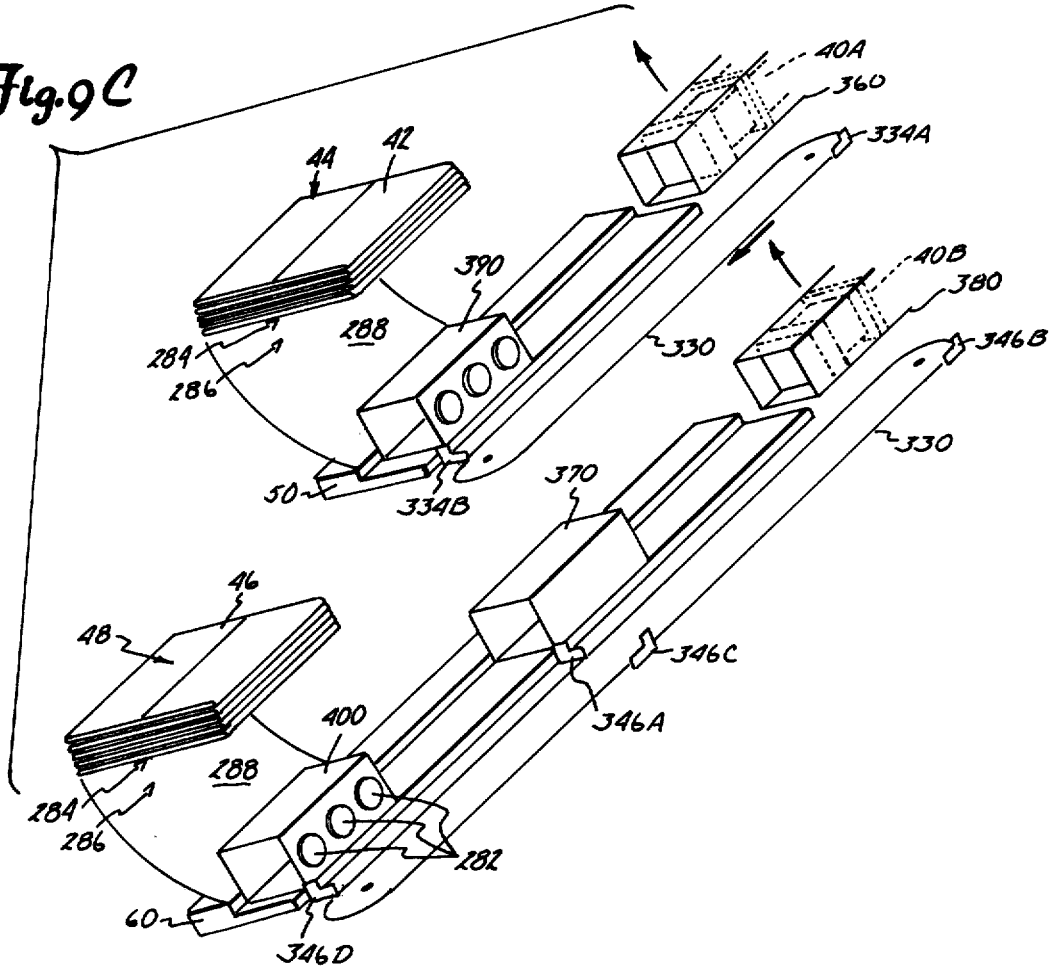

FIGS. 9A, 9B and 9C illustrate the sequential operation of the two-stage loading mechanism of the present invention in generally diagrammatic form. In FIG. 9A, an operating cycle is about to begin. Mandrels 40A and 40B are in position, and erected carton 360 is in upper chute 50 immediately below the basket assembly of first magazine 44. Carton 370 is located in lower chute 60 immediately below the basket assembly of magazine 48, and carton 380 is positioned along chute 60 in a position which is immediately below carton 360 in upper chute 50.

As the cycle begins, upper drive chain 330 and lower drive chain 336 begin to move. Carton 360 is pushed by lug 334A along chute 50 toward mandrel 40A. At the same time, lug 346A begins pushing carton 370 toward the intermediate position along lower chute 60 while lug 346B begins pushing carton 380 along lower chute 60 toward mandrel 40B. During this initial movement of cartons 360, 370 and 380, cam surface 304 has a dwell position, so that picker heads 280 are not moving.

Once cartons 360 and 370 clear their respective picker heads 280, cam track 304 causes cam cam follower arm 308 to be driven downward, thus rotating picker heads 280 upward so that vacuum picker cups 282 engage the lowermost carton blanks in magazines 44 and 48. Cam track 304 then causes follower arm 308 to begin movement, upward which rotates picker heads 280 back downward toward their original positions. As this occurs, as illustrated in FIG. 9B, new carton 390 is being erected and deposited into upper chute 50 and new carton 400 is being erected and deposited in lower chute 60.

As shown in FIG. 9C, at the end of one rotation of shaft 300 (i.e. one cycle of machine 10), new cartons 390 and 400 have been deposited in chutes 50 and 60, respectively, and carton 370 has reached the intermediate position. Cartons 360 and 380 have been fully inserted onto mandrels 40A and 40B, respectively. At this point, lug 334B has reached the position immediately behind carton 390 and lug 346D has reached a similar position behind carton 400. The rotation of drive shaft 300 stops, and spindle 24 is rotated to bring a new pair of mandrels 40A and 40B into alignment with chutes 50 and 60, respectively. A new cycle of the loader assembly is then ready to begin.

As can be seen from FIGS. 9A-9C, the carton erected and deposited in upper chute 50 at the end of one cycle is driven onto mandrel 40A at the beginning of the next cycle, while the carton erected and deposited in lower chute 60 at the end of one cycle is advanced to an intermediate position during the next cycle while a preceding carton is driven onto mandrel 40B.

The two-stage loading mechanism of the present invention permits chutes 50 and 60 to be very closely spaced, and allows fully synchronized operation of the loading of both mandrels 40A and 40B. In addition, easy access to both magazines 44 and 48 for repair and maintenance adjustment is permitted.

In conclusion, the carton erecting, filling and sealing machine of the present invention provides significant increases in production rate without a corresponding increase in floor space consumed by the machine. By using a double mandrel/double indexing machine with a pair of vertically aligned mandrel assemblies, two parallel conveyor lines and mandrel assemblies driven by a common drive system are possible, thus providing a four-fold increase in production rate without significantly increasing floor space required, and while permitting easy access to all components and subsystems of the machine for maintenace, cleaning and repair.

Although the present invention has been described with reference to preferred embodiments, workers skilled in the art will recognize that changes may be made in form and detail without departing from the spirit and scope of the invention.

What is claimed is:

1. A machine for erecting flat, collapsed cartons and for filling and sealing the erected cartons during a sequence of operating cycles, the machine comprising:

a frame;

first and second spindles mounted on the frame for simultaneous rotation about a common horizontal axis;

first and second pairs of mandrels mounted side-by-side on the first and second spindles, respectively, at each of a plurality of equally spaced circumferential positions, each first pair of mandrels extending outward from the first spindle in a generally radial direction with respect to the horizontal axis to define a first vertical plane and each second pair of mandrels extending outward from the second spindle in a generally radial direction with respect to the horizontal axis to define a second vertical plane which is parallel to the first vertical plane;

a plurality of first and second work stations mounted side-by-side on the frame in the first and second vertical planes, respectively; the plurality of first work stations being positioned circumferentially about the horizontal axis in the first plane to surround the first spindle, and the plurality of second work stations positioned circumferentially about the horizontal axis in the second plane to surround the second spindle;

intermittent spindle drive means for rotating simultaneously the first and second spindles and the mandrels mounted thereon in the first and second vertical planes, respectively, about the horizontal axis during each operating cycle to bring each first pair of mandrels sequentially into alignment with each of the first work stations and each second pair of mandrels sequentially into alignment with each of the second work stations;

first and second supply means aligned with the first and second vertical planes, respectively for holding supplies of flat carton blanks;

first and second erecting means aligned with the first and second vertical planes, respectively for erecting pairs of flat carton blanks into open-end tubular form during each operating cycle;

first and second loader means positioned at first and second loader work stations, respectively, for loading a pair of open-end tubular carton blanks onto the first pair of mandrels aligned with the first loader work station during each operating cycle and loading a pair of open-end tubular carton blanks onto the second pair of mandrels aligned with the second loader work station during each operating cycle;

means positioned at the work stations in the first and second vertical planes subsequent to the first and second loader work stations for successively forming and sealing bottom ends of the pair of carton blanks carried by each first and second pairs of mandrels;

first and second parallel horizontal conveyor tracks aligned with the first and second vertical planes, respectively;

first and second carton transfer means positioned at first and second transfer work stations for successively transferring a pair of carton blanks with their bottom ends sealed from each of the first and second pairs of mandrels to the first and second conveyor tracks, respectively;

a plurality of side-by-side first and second work stations positioned along the first and second conveyor tracks, respectively;

means positioned at the first and second work stations along the first and second conveyor tracks for filling, closing and sealing top ends of each pair of carton blanks; and first and second carton conveyor means operatively synchronized with the intermittent spindle drive means for simultaneously advancing carton blanks by pairs along the first conveyor track and along the second conveyor track in stepped sequence from one work station to another during each operating cycle.

2. A machine for erecting flat, collapsed cartons and for filling and sealing the erected cartons, the machine comprising:

a frame;

a first spindle mounted on the frame for rotation about a horizontal axis;

a pair of mandrels mounted on the first spindle at each of a plurality of equally spaced circumferential positions, each pair of mandrels extending outward from the first spindle in a generally radial direction with respect to the horizontal axis;

a plurality of work stations positioned on the frame in a first substantially vertical plane normal to the horizontal axis;

intermittent spindle drive means for rotating the first spindle and the mandrels in the first vertical plane about the horizontal axis in a stepped sequence to bring each pair of mandrels sequentially into alignment with each work station;

means for holding a supply of flat carton blanks;

means for erecting flat carton blanks from the supply into open-end tubular form wherein the means for erecting flat carton blanks comprises:

first picker means for removing a flat carton blank from the supply, opening the flat carton blank to a generally rectangular cross-section open-end tubular form, and depositing the open-end tubular carton blank in a first chute; and second picker means for removing a flat carton blank from the supply, opening the flat carton blank to a generally rectangular cross-section open-end tubular form, and depositing the open-end tubular carton blank in a second chute;

loader means positioned at a loader work station for loading a pair of open-end tubular carton blanks onto the pair of mandrels aligned with the loader work station, wherein the loader means comprises:

means for advancing an open-end tubular carton blank deposited by the first picker means along the first chute onto one mandrel of the pair of mandrels aligned with loader work station; and means for simultaneously advancing an open-end tubular carton blank deposited by the second picker means along the second chute to an intermediate position and a previously deposited carton blank from the intermediate position onto the other mandrel of the pair of mandrels aligned with the loader work station;

means positioned at the work stations in the first vertical plane subsequent to the loader work station for successively forming and sealing bottom ends of the pair of carton blanks carried by each pair of mandrels;

first carton transfer means positioned at a transfer work station for successively transferring a pair of carton blanks with their bottom ends sealed from each pair of mandrels to a substantially horizontal first conveyor track;

a plurality of work stations positioned along the first conveyor track;

means positioned at the work stations along the first conveyor track for filling, closing and sealing top ends of each pair of carton blanks; and carton conveyor means operatively synchronized with the intermittent spindle drive means for advancing each pair of carton blanks along the first conveyor track in stepped sequence from one work station to another.

3. The machine of claim 1 wherein the first conveyor track is essentially coplanar with the first vertical plane.

4. The machine of claim 1 wherein the first and second chutes are generally parallel to one another.

5. The machine of claim 4 wherein the first and second chutes are aligned in the substantially vertical plane.

6. The machine of claim 5 wherein the first chute is positioned generally above the second chute.

7. The machine of claim 6 wherein the means for holding a supply of flat carton blanks comprises:

a first magazine adapted to hold a first supply of carton blanks, from which the first picker means removes carton blanks; and a second magazine adapted to hold a second supply of carton blanks from which the second picker means removes carton blanks.

8. A carton forming machine comprising:

a mandrel assembly rotatably driven with a step-by-step indexing motion about a horizontal axis of rotation, the mandrel assembly including first and second mandrels at each of a plurality of equally spaced circumferential positions, the first and second mandrels extending outward in a generally radial direction with respect to the horizontal axis;

a plurality of work stations positioned in a substantially vertical plane normal to the horizontal axis;

drive means for rotating the mandrel assembly in the vertical plane about the horizontal axis to bring each set of first and second mandrels sequentially into alignment with each of the work stations;

first magazine means for holding a first supply of flat carton blanks;

second magazine means for holding a second supply of flat carton blanks;

a first chute positioned generally below the first magazine means and aligned in the substantially vertical plane at a loader work station;

a second chute positioned below the second magazine means and generally parallel to and below the first chute at the loader work station;

means for removing a flat carton blank from the first magazine means, opening the flat carton blank to a generally rectangular open-end tubular form and depositing the open-end tubular carton blank in the first chute;

means for removing a flat carton blank from the second magazine means, opening the flat carton blank to a generally rectangular cross-section open-end tubular form, and depositing the open-end tubular carton blank in the second chute;

means for advancing an open-end tubular carton blank along the first chute onto the first mandrel aligned with the loader work station; and means for simultaneously advancing an open-end tubular carton blank along the second chute to an intermediate position and a previously deposited open-end tubular carton blank from the intermedate position onto the second mandrel of the pair of mandrels aligned with the loader work station.

9. The machine of claim 8 wherein the intermediate position is essentially below the position of the open-end tubular carton blank deposited in the first chute prior to advancing of the carton blanks in the first and second chute.

10. The machine of claim 9 wherein the second chute has a length which is essentially twice the length of the first chute.

11. The machine of claims 8 or 10 wherein the means for advancing an open-end tubular carton blank along the first chute comprises a first drive chain having a plurality of carton pushing lugs thereon; and wherein the means for simultaneously advancing the open-end tubular carton blanks along the second chute comprises a second drive chain having a plurality of carton pushing lugs thereon.

12. The machine of claim 11 and further comprising: means for driving the first and second drive chains simultaneously.

13. The machine of claim 12 wherein the first drive chain has two equally spaced carton pushing lugs thereon, and wherein the second drive chain has four equally spaced carton pushing lugs thereon, and wherein the second drive chain has a length which is twice the length of the first drive chain.

* * * * *